US007325421B2

(12) United States Patent
Sasser et al.

(10) Patent No.: US 7,325,421 B2
(45) Date of Patent: Feb. 5, 2008

(54) PRINTED LOOP FABRIC AND METHOD FOR PRODUCING THE SAME

(76) Inventors: Michael P. Sasser, 206 S. Pointe, Cowpens, SC (US) 29330; Kenny Greene, 350 Bryant Rd. Apt. #A-32, Spartanburg, SC (US) 29303; Howell B. Eleazer, 226 Donegal Dr., Moore, SC (US) 29369; John M. Blackman, 108 Juniper Ct., Spartanburg, SC (US) 29301

( * ) Notice: Subject to any disclaimer, the term of this patent is extended or adjusted under 35 U.S.C. 154(b) by 1322 days.

(21) Appl. No.: 10/305,562

(22) Filed: Nov. 27, 2002

(65) Prior Publication Data

US 2004/0099020 A1 May 27, 2004

(51) Int. Cl.
*D04B 21/00* (2006.01)

(52) U.S. Cl. ..... 66/195

(58) Field of Classification Search ..... 66/195, 66/202; 427/466, 256, 270
See application file for complete search history.

(56) References Cited

U.S. PATENT DOCUMENTS

| | | | | | |
|---|---|---|---|---|---|
| 3,009,235 | A * | 11/1961 | De Mestral | 428/86 |
| 4,290,832 | A * | 9/1981 | Kalleberg | 156/72 |
| 4,624,116 | A * | 11/1986 | Rogers | 66/193 |
| 4,770,917 | A * | 9/1988 | Tochacek et al. | 428/95 |
| 4,931,343 | A * | 6/1990 | Becker et al. | 428/95 |
| 5,003,873 | A * | 4/1991 | Lauber | 101/219 |
| 5,019,073 | A | 5/1991 | Roessler et al. | 604/391 |
| 5,048,418 | A * | 9/1991 | Hars et al. | 101/178 |
| 5,125,246 | A * | 6/1992 | Shytles | 66/193 |
| 5,611,791 | A | 3/1997 | Gorman et al. | 604/391 |
| 5,643,397 | A | 7/1997 | Gorman et al. | 156/435 |
| 5,736,214 | A * | 4/1998 | Billarant | 428/92 |
| 5,789,058 | A * | 8/1998 | Usher et al. | 428/88 |
| 5,875,526 | A * | 3/1999 | Yamaguchi | 24/445 |
| 5,979,315 | A * | 11/1999 | Haan et al. | 101/181 |
| 6,096,667 | A * | 8/2000 | Rhode | 442/313 |
| 6,101,940 | A * | 8/2000 | Huff | 101/213 |
| 6,158,255 | A * | 12/2000 | Ternon | 66/194 |
| 6,203,645 | B1 * | 3/2001 | Gilpatrick | 156/166 |
| 6,203,880 | B1 * | 3/2001 | Gilpatrick | 428/92 |
| 6,367,291 | B2 * | 4/2002 | Ternon | 66/195 |
| 6,408,754 | B2 | 6/2002 | Siler et al. | 101/401.1 |
| 6,410,099 | B1 * | 6/2002 | Loncar, Jr. | 427/466 |
| 6,449,989 | B2 * | 9/2002 | Ternon | 66/195 |
| 6,730,069 | B2 * | 5/2004 | Tanzer et al. | 604/391 |
| 6,910,353 | B2 | 6/2005 | Sasser et al. | 66/191 |

* cited by examiner

*Primary Examiner*—Danny Worrell
(74) *Attorney, Agent, or Firm*—Terry T. Moyer; Cheryl J. Brickey

(57) ABSTRACT

The present invention relates generally to a printed loop fabric with improved graphic visibility and clarity which may be used as the female portion of a mechanical closure system. The loop fabric is generally comprised of a knit fabric, and more specifically, of a warp knit, weft inserted fabric. One method of creating the printed loop fabric includes coating the backside of the loop fabric with a thermoplastic material and then printing the face side of the coated fabric. Alternatively, the printed loop fabric may be achieved by applying a thermoplastic material to the backside of the loop fabric and printing on the thermoplastic material. The printed loop fabric may also be produced by applying a thermoplastic material to the backside of a low loop fabric and laminating a pre-printed film to the thermoplastic material. The fabric can be made without sacrificing the fabric's hook to loop engagement strength.

16 Claims, 9 Drawing Sheets

*FIG. —3—*

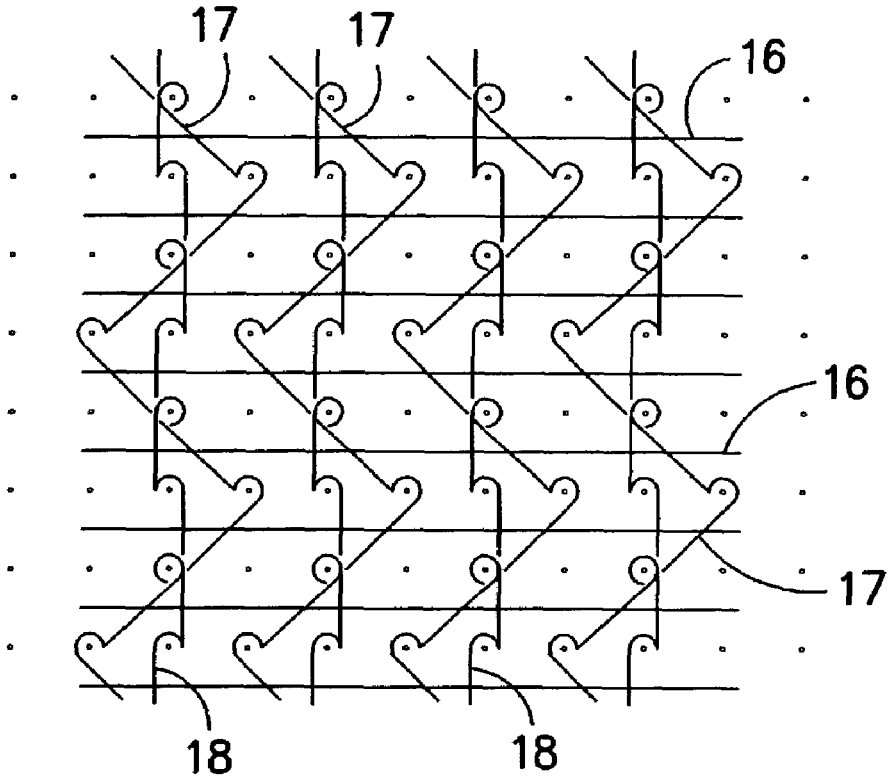
FIG. –5–
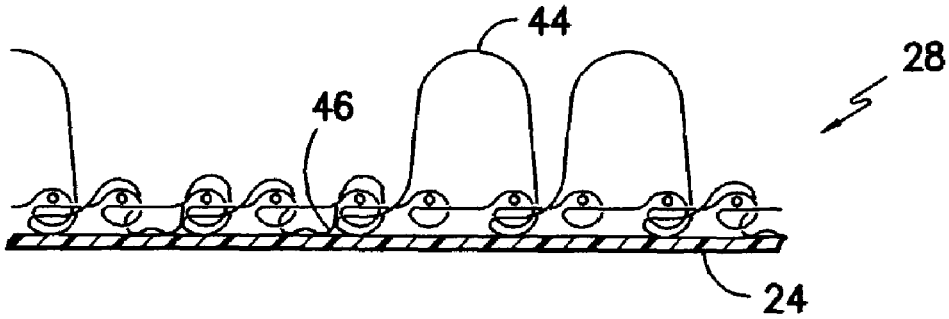
FIG. –6–

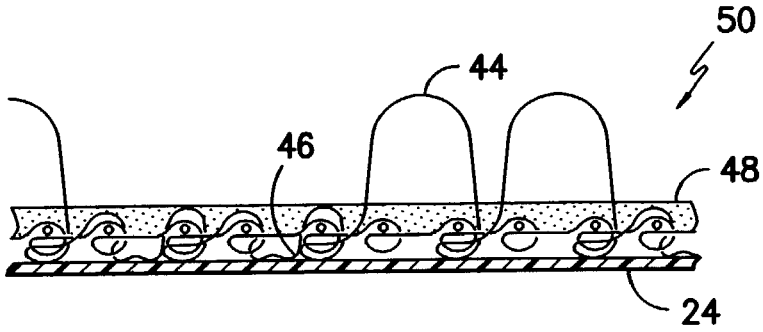
FIG. –9–
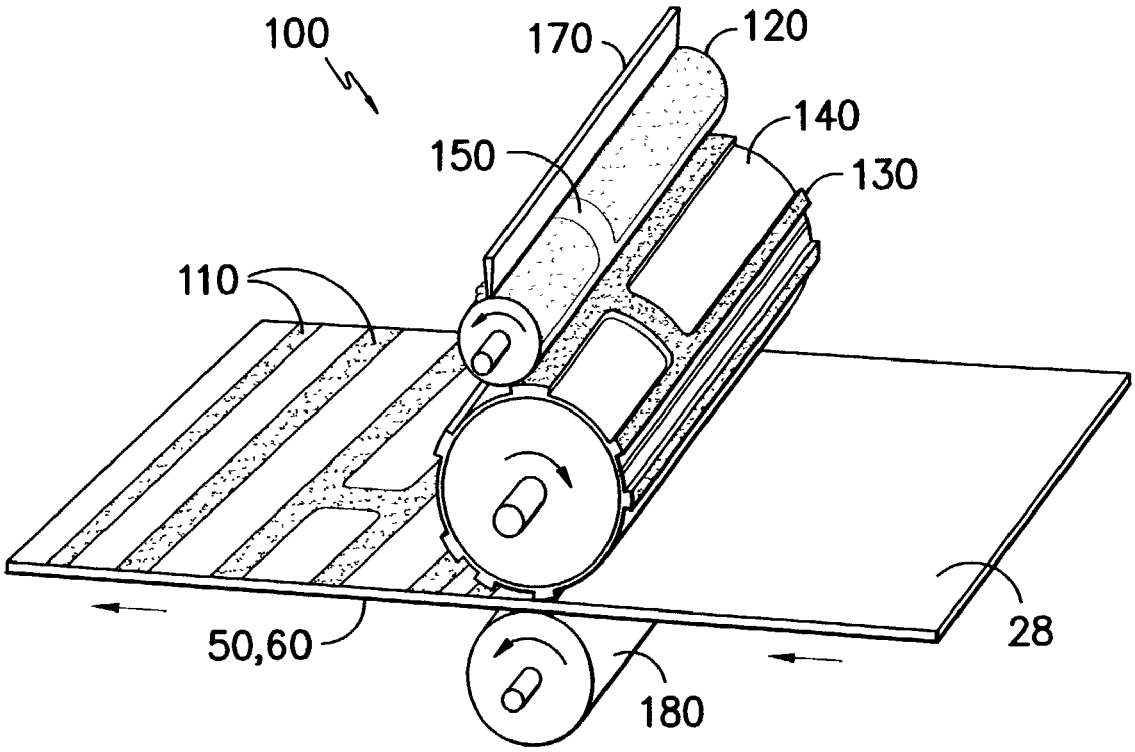
FIG. –10–

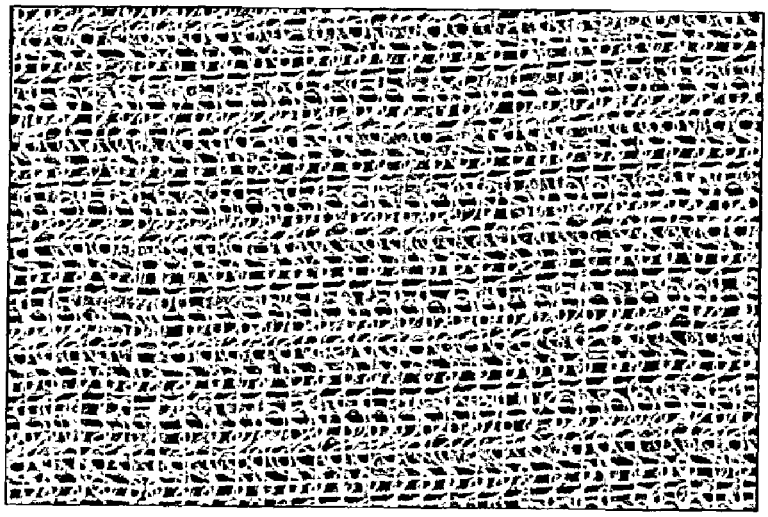
FIG. –13A–
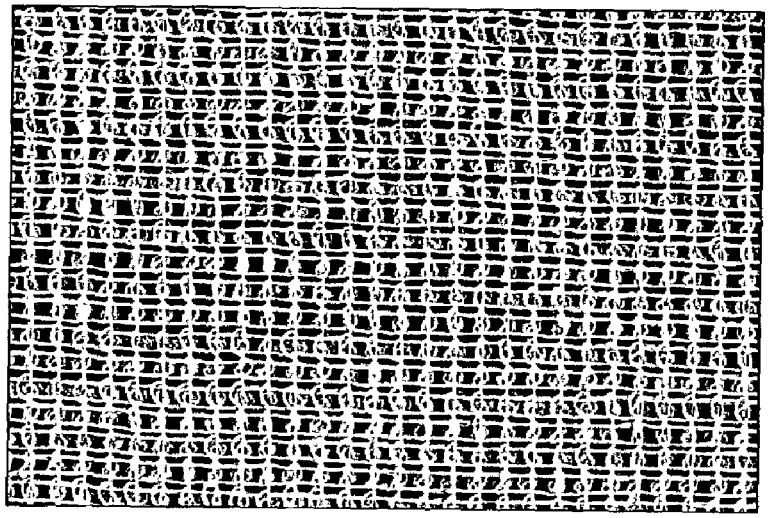
FIG. –13B–

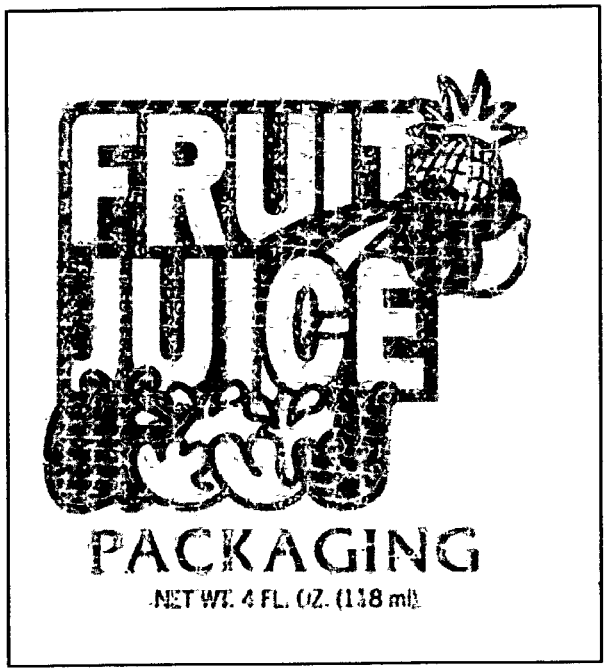
*FIG. –14A–*
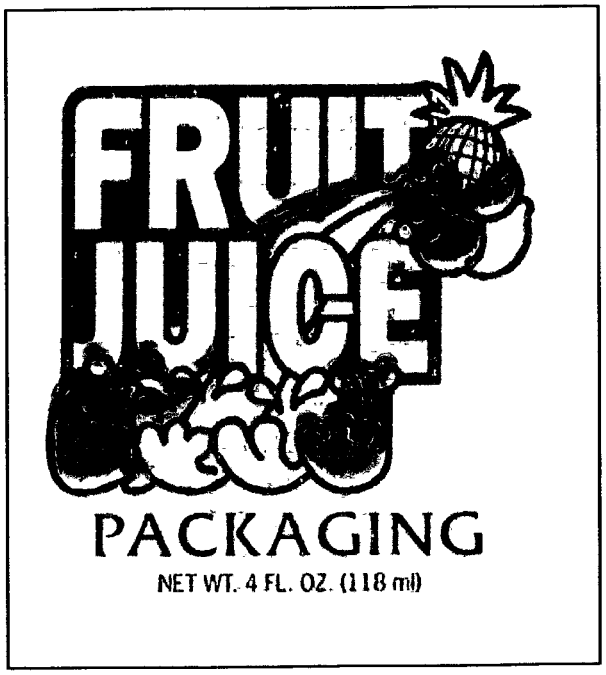
*FIG. –14B–*

PRINTED LOOP FABRIC AND METHOD FOR PRODUCING THE SAME

BACKGROUND OF THE INVENTION

The present invention relates generally to a printed loop fabric with improved graphic visibility and clarity which may be used as the female portion of a mechanical closure system. The loop fabric is generally comprised of a knit fabric. More specifically, the fabric is comprised of a warp knit, weft inserted lap side loop pile fabric having adjacent loops in each wale alternate from one direction to the other. The methods employed to create the printed loop fabric having improved graphic visibility and clarity also provide a printed loop fabric that exhibits sufficient hook to loop engagement strength desired for the fabric's end use as the female portion of a mechanical closure system.

One method of creating the printed loop fabric includes coating the backside of the loop fabric with a thermoplastic material and then printing the face side of the coated fabric. This method generally eliminates the need to rely upon the "see through" characteristics of the fabric, adhesive, or film comprising the product, in order to see the printed image and results in a printed loop fabric with improved graphic visibility and clarity.

Alternatively, the printed loop fabric may be achieved by applying a thermoplastic material to the backside of the loop fabric and printing on the thermoplastic material. This method of obtaining a printed loop fabric relies upon the see through characteristics of the fabric. Accordingly, it may be preferable to use a loop fabric comprised of low loops which provides increased open space between the yarns of fabric. The resulting fabric exhibits improved graphic visibility and clarity of the printed image applied to the backside of the fabric.

The printed loop fabric may also be produced by applying a thermoplastic material to the backside of a loop fabric comprised of low loops and laminating a pre-printed film to the thermoplastic material. Again, due to the increased open space between the yarns of the low loop fabric, the printed low loop fabric having a pre-printed film laminated to the thermoplastic material also exhibits improved graphic visibility and clarity when compared with other similarly constructed fabrics.

The printed loop fabric of the present invention may be utilized as part of the mechanical closure system for disposable diaper products. It has been generally established that consumer market demands a product printed with patterns, characters, or words for the purpose of landing zone identification, which provides a locator for the hook portion of the closure system, and brand recognition. Accordingly, market advantage may be gained in offering a loop product with the best print visibility and clarity. Currently, most loop fabrics created for this purpose are laminated to pre-printed films and have less print clarity and graphic visibility than the printed loop fabric of the present invention. The current invention discloses a printed loop fabric with improved graphic visibility and clarity and sufficient hook to loop engagement strength, which are important attributes for the fabric's end use as the female portion of a mechanical closure system. In at least one embodiment, the product may reduce the length of the supply chain by eliminating the need for a separate film manufacturer and printer because the printing may be applied directly to the loop fabric without the need for a pre-printed film. Furthermore, the fabric of the present invention may allow for the retention of an unprinted inventory of loop fabric which may be printed on a "print to order" basis, thus, reducing industry run size requirements.

BRIEF DESCRIPTION OF THE DRAWINGS

FIG. 5 is a point diagram of the action of the guide bars of the knitting machine for the printed low loop fabric.

FIG. 6 is a view similar to FIG. 1 showing the printed loop fabric with a thermoplastic material on the backside of the fabric.

FIG. 9 is a view similar to FIG. 6 showing one embodiment of the printed loop fabric of the present invention with printing on the face of the fabric.

FIG. 10 is a schematic view of the method for flexographic printing the loop fabric.

FIG. 13A is a scanned image of standard loop fabric described in Example 1.

FIG. 13B is a scanned image of the low loop fabric described in Example 1.

FIG. 14A is a scanned image of a printed low loop fabric described in Example 2 having a thermoplastic material extrusion coated on the backside of the low loop fabric and having printing on the thermoplastic material.

FIG. 14B is a scanned image of a face printed low loop fabric described in Example 2 having a thermoplastic material extrusion coated on the backside of the low loop fabric and having printing on the face of the low loop fabric.

DETAILED DESCRIPTION OF THE INVENTION

Figure 1:
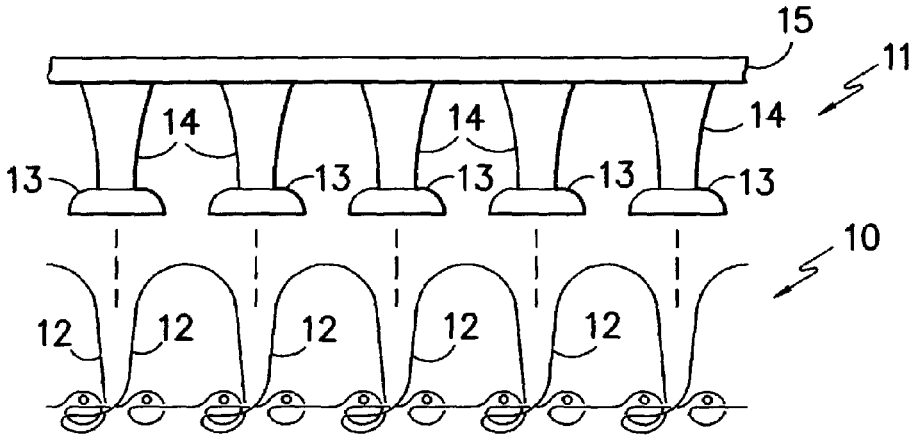
FIG. 1 is a schematic representation of the hook fasteners in relation to the printed loop fabric.

The printed loop fabric of the present invention is generally a knit fabric. The printed loop fabric is preferably formed from a warp knitting process. More specifically, the fabric may be formed from a warp knit, weft insertion fabric formation process. However, it is contemplated that the printed loop fabric may alternatively be formed from a tricot knitting process, which is another form of warp knitting.

The printed loop fabric formed from the warp knit, weft insertion process is typically comprised of warp yarns, weft yarns, and tie yarns (or chain stitch yarns). The comprising the printed loop fabric may be of any synthetic fiber type. Synthetic fibers include, for example, polyester, acrylic, polyamide, polyolefin, polyaramid, polyurethane, or blends thereof. More specifically, polyester includes, for example, polyethylene terephthalate, polytrimethylene terephthalate, polybutylene terephthalate, polylactic acid, or combinations thereof. Polyamide includes, for example, nylon 6, nylon 6,6, or combinations thereof. Polyolefin includes, for example, polypropylene, polyethylene, or combinations thereof. Polyaramid includes, for example, poly-p-phenyleneteraphthalamid (i.e., Kevlar®), poly-m-phenyleneteraphthalamid (i.e., Nomex®), or combinations thereof.

The printed loop fabric may be comprised of a variety of fiber types such as staple fiber, filament fiber, spun fiber, or combinations thereof. The printed loop fabric can be formed from fibers or yarns of any size, including microdenier fibers and yarns (fibers or yarns having less than one denier per filament). Preferably, the yarns comprising the printed loop fabric may independently have a denier of between about 20 and about 300, and more preferably, between about 40 and about 200. Furthermore, the fabric may be partially or wholly comprised of multi-component or bi-component fibers or yarns which may be splittable along their length by chemical or mechanical action.

The yarns comprising the printed loop fabric may be exposed to a texturing process. It may be preferable that the warp yarns are textured because the texturing process generally adds bulk to the yarns, which may assist in engagement of the hooks with the loops made from the textured warp yarns. During the texturing process, it may be desirable to apply a lubricant, such as mineral oil, to the yarn prior to the start of the texturing process to assist in processing the yarn. Chemical application may be accomplished by immersion coating, padding, spraying, foam coating, or by any other technique whereby one can apply a controlled amount of a liquid suspension to the yarns.

It is also contemplated that prior to the fabric formation process, the yarns may have various other additives incorporated within them, or on them, for the purpose of imparting certain characteristics to the printed loop fabric. For example, chemicals may be added which provide antimicrobial properties, antistatic properties, pilling resistance, or abrasion resistance to the yarns, and ultimately to the final fabric formed therefrom. It is also contemplated that the yarns may be dyed in order to impart color to the printed loop fabric. Dyeing may be accomplished by any traditional method known to those skilled in the art, such as via package dyeing, solution dyeing, or beam dyeing.

Similarly, after the loop fabric has been formed, the fabric may be treated with one or more chemical finishes. For example, it may be desirable to treat the fabric with one or more chemical finishes such as water repellants, soil release agents, antimicrobial agents, antibacterial agents, anti-fungal agents, flame retardants, UV inhibitors, antioxidants, coloring agents, lubricants, anti-static agents, fragrances, and the like, or combinations thereof. Chemical application may be accomplished by immersion coating, padding, spraying, foam coating, or by any other technique whereby one can apply a controlled amount of a liquid suspension to a fabric. Employing one or more of these application techniques may allow the chemical to be applied to the fabric in a uniform manner.

Looking now to FIG. 1, the loop fabric 10 with upstanding loops 12 are shown in position where the loops 12 can be engaged by hook member 11, which consists of the hooks 14 connected to a support member 15 and having a grasping portion 13. In practice, the fabric 10 would be connected to a supporting structure (not shown) so that when an article is to be secured in a fixed position, the hook member 11 will be projected towards the loops 12, and the hooks 14 will engage the loops 12 and be secured therein. The hook member 11 is not, per se, a part of the invention and can be any suitable type, such as that formed by the molding or casting of nylon to form the desired configuration shown in FIG. 1.

Figure 2:
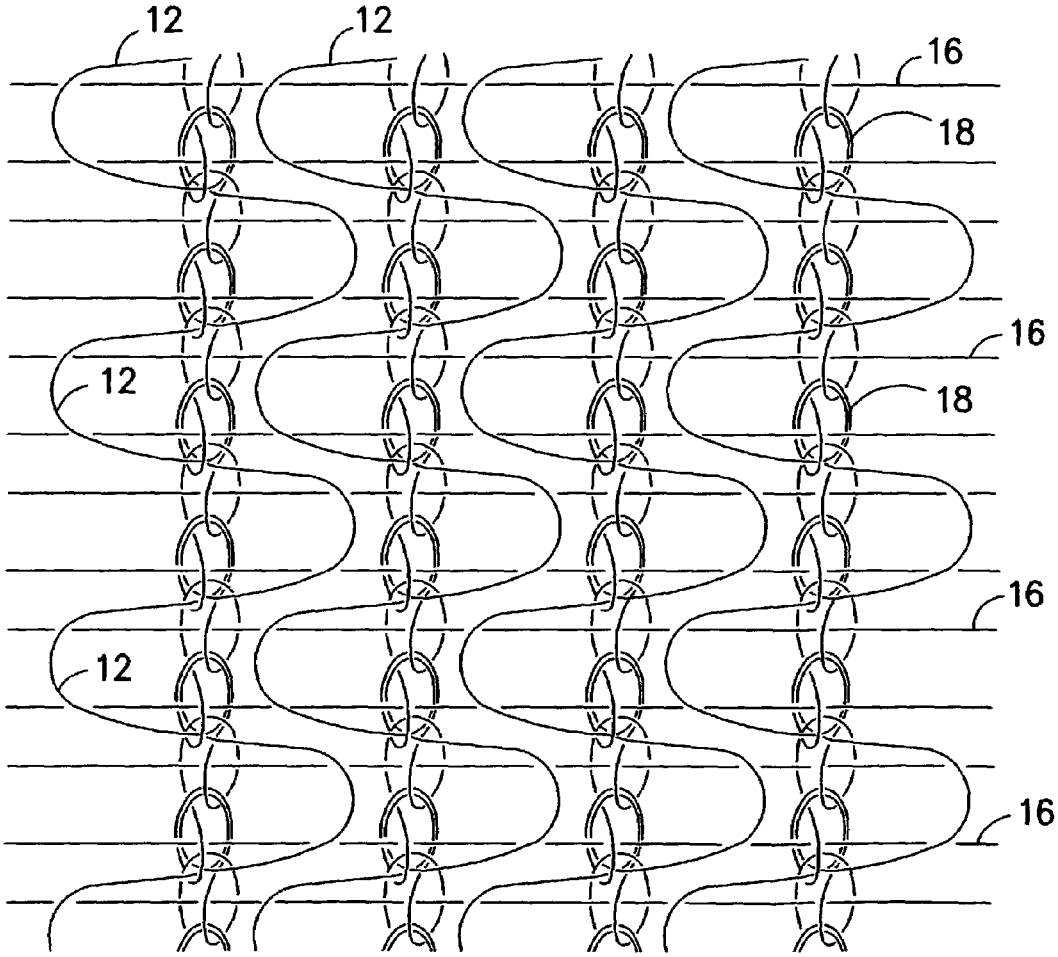
FIG. 2 is the top view of the lap (technical back) side of the printed loop fabric.

The loop fabric 10 is a warp knit, weft inserted fabric knit on a two-bar, weft insertion warp knitting machine. As indicated in FIGS. 1 and 2, the loops 12 are lap loops formed by the front bar of the knitting machine while each of the weft inserted yarns 16 are held therein substantially parallel to one another by and between the chain stitch wales 18 formed by the back bar. The loop yarn 12 and weft yarn 16 are preferably 70 denier textured polyester yarns, but as previously stated, they can be in the range of about 20 to about 300 denier, and more preferably, in the range of about 40 to about 200 denier. The fabric 10 thereby presents a surface of loops 12 which can be readily manufactured on a warp knitting machine and at the same time possesses added strength due to the insertion of the weft yarn 16. The loops 12, as shown in FIG. 1, are free loops in the sense that they are open and project freely upward and are connected only at the base to their respective wale.

It should be noted that the free loops in each wale alternate from one direction to the other along the wale (e.g. in FIG. 2, one loop is to the left and the next adjacent loop in the same wale is to the right). Also, the loops in each wale are shifted in the same direction as the loop in the next adjacent wale. This shifting of the loops 12 provides for a more secure and positive engagement of the loops 12 by the grasping portion 13 of the hook member 11 of the male interconnecting member.

FIGS. 1-5 show various embodiments of loop fabric constructions which may be utilized for achieving the printed loop fabric of the present invention. More specifically, the fabric constructions shown and described in FIGS. 1-5 may have a thermoplastic material applied to the backside of the fabric and may then be exposed to a printing process which applies a printed image either to the face of the fabric or to the thermoplastic material on the backside of the fabric. Alternatively, the fabric construction shown and described in FIG. 5, which illustrates the low loop fabric construction, may have a thermoplastic material applied to the backside of the fabric and a pre-printed film laminated to the thermoplastic material.

Figure 3:
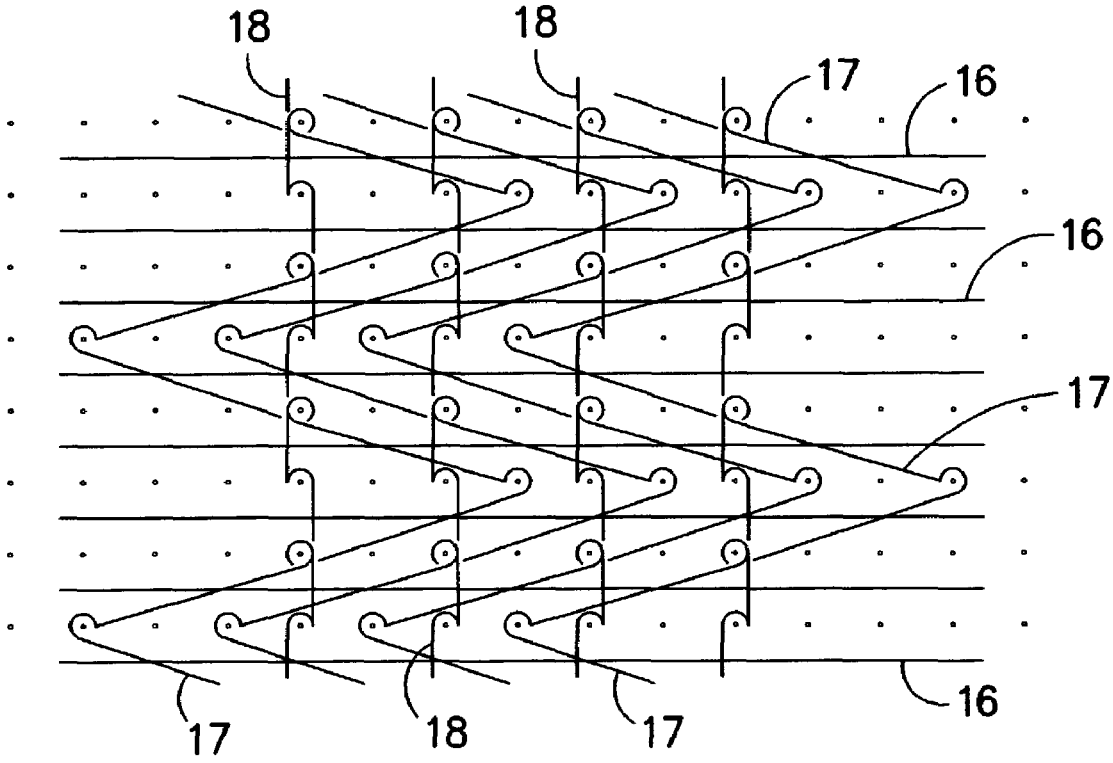
FIG. 3 is a point diagram of the action of the guide bars of the knitting machine for one embodiment of the printed loop fabric.

FIG. 3 shows one form of the loop fabric constructed with the pattern wheel for the front bar 70 denier textured polyester yarn set to knit a 3-4/0-1/4-3/7-6//stitch 17, and the pattern wheel for the back bar 40 denier flat polyester yarn set to knit a 1-0/0-1/0-1/1-0//chain stitch 18. The weft inserted filling yarn 16 is a 70 denier textured polyester yarn. The lap loop 12 for engagement by the hooks 14 will have a potential height greater than the distance between adjacent wales in the fabric.

Figure 4:
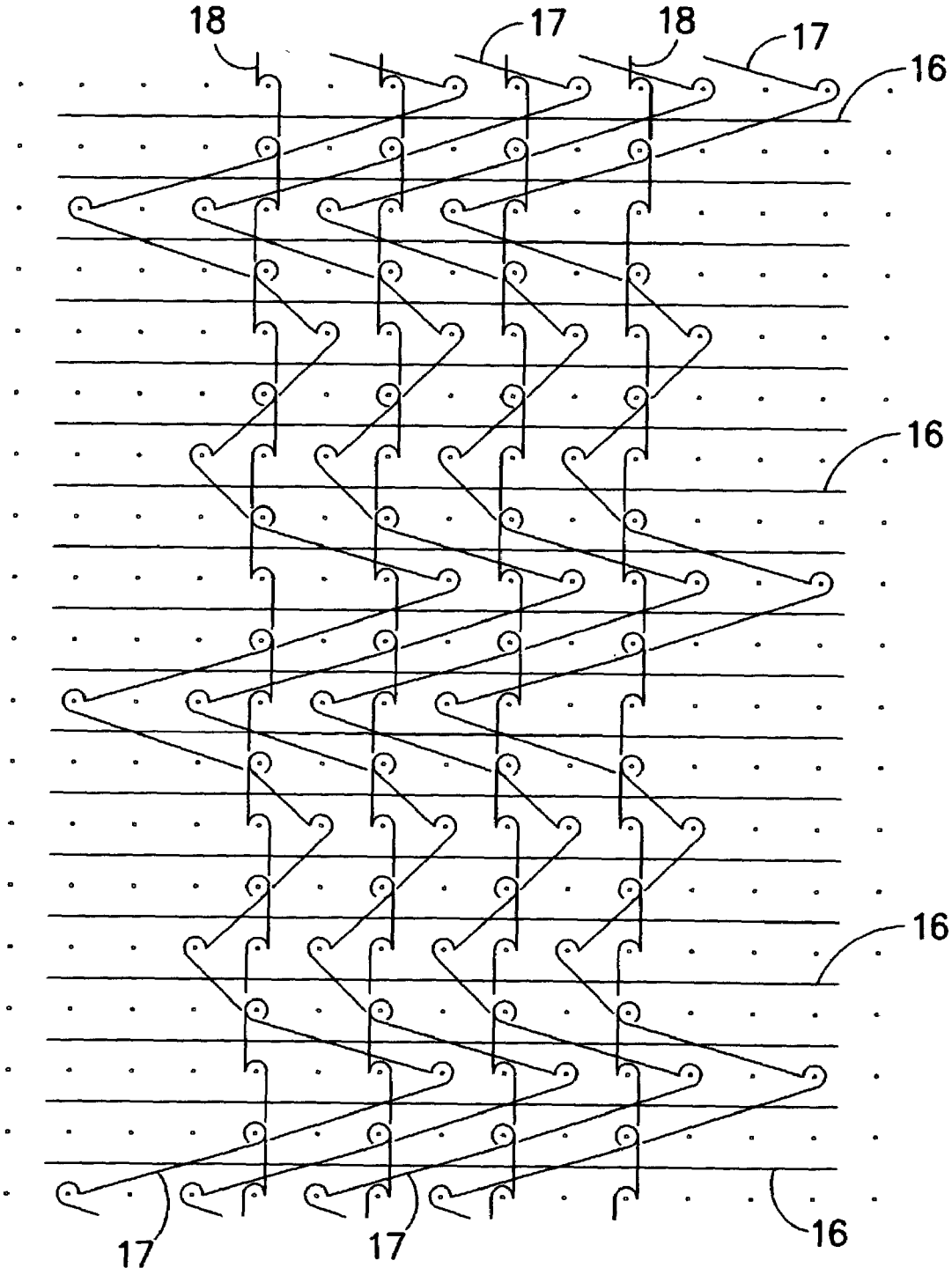
FIG. 4 is a point diagram of the action of the guide bars of the knitting machine for another embodiment of the printed loop fabric.

FIG. 4 illustrates a loop fabric 10 which has a set of large loops to the left and right side followed by a set of short loops. The pattern wheel for the front bar is set to knit a 3-4/2-3/4-3/7-6/3-4/0-1/4-3/5-4//stitch 17, and the back bar is set to knit a 1-0/0-1/0-1/1-0//chain stitch 18. As in the above embodiments, the front bar yarn 17 is 70 denier textured polyester, the back bar yarn 18 is 40 denier flat polyester yarn, and the weft inserted filling yarn 16 is 70 denier textured polyester yarn.

FIG. 5 shows the loop fabric 10 constructed with the pattern wheel for the front bar set to knit a 1-2/0-1/2-1/3-2//stitch 17, and the pattern wheel for the back bar set to knit a 1-0/0-1/0-1/1-0/1//chain stitch 18. As in the above embodiments, the front bar yarn 17 is 70 denier textured polyester, the back bar yarn 18 is 40 denier flat polyester yarn, and the weft inserted filling yarn 16 is 70 denier textured polyester yarn. This form of the fabric provides a lap side loop the height of which is slightly less than the spacing between adjacent wales of the chain stitch yarn 18. Thus, this fabric construction generally provides a low loop fabric having increased open space between the warp and weft yarns. Accordingly, the see through characteristics of this fabric provide a printed low loop fabric having improved graphic visibility and clarity when the thermoplastic material on the backside of the fabric is printed or when a pre-printed film is laminated to the thermoplastic material on the backside of the low loop fabric.

FIG. 6 is similar to FIG. 1 but further shows a loop fabric 28 backcoated with a thermoplastic material 24. The thermoplastic material 24 is preferably polypropylene. However, other suitable thermoplastic materials include polyolefin, polyester, polyamide, polyurethane, acrylic, silicone, melamine compounds, polyvinyl acetate, polyvinyl alcohol, nitrile rubber, ionomers, polyvinyl chloride, polyvinylidene chloride, chloroisoprene, or combinations thereof. The polyolefin may be polyethylene, polypropylene, ethylvinyl acetate, ethylmethyl acetate, or combinations thereof.

In one embodiment, a thermoplastic material 24 is extrusion coated on the back of the loop fabric 10 using a pressure roll and a chill roll to provide the desired product. Alternative methods for application may include other coating methods, such as, for example, immersion, knife/comma, roll, gravure, pad/nip, pad/vacuum, hot melt, or powder, or various laminating methods, such as with adhesive lamination or heat and pressure lamination.

Figure 7:
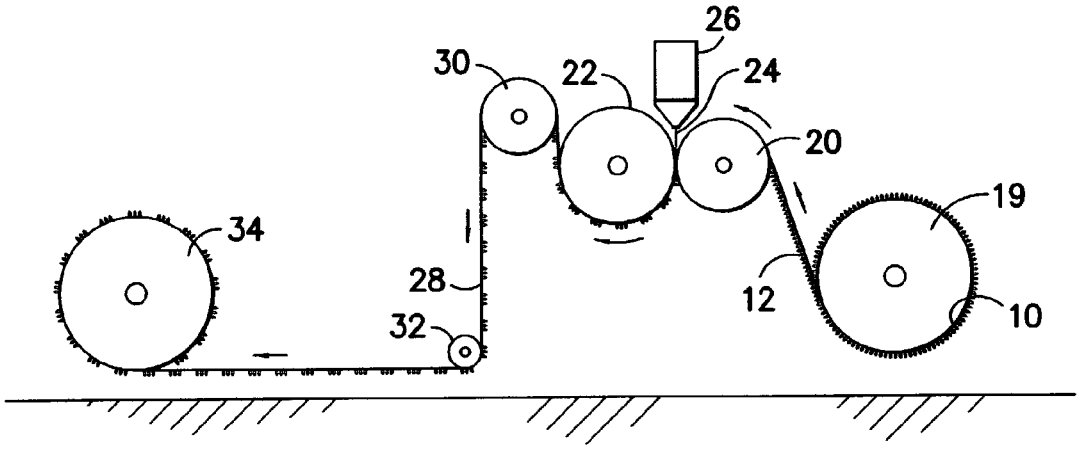
FIG. 7 is a schematic view of the method for applying a thermoplastic material to the backside of the printed loop fabric.

As shown in FIG. 7, the loop fabric 10 provided from a supply roll 19 is transported over a roll 20 with the loops 12 facing towards roll 20 into a nip between the roll 20 and a chill roll 22 which is being supplied a thermoplastic material 24 from an extruder 26. From the chill roll 22 the backcoated loop fabric 28 is supplied over guide rolls 30 and 32 to a take-up roll 34. When the thermoplastic material 24 is extrusion coated on a loop fabric 10 such as shown, for example, in FIG. 7, the thermoplastic material 24 may tie down some of the loops 12 providing unacceptable holding and peel strength. The processes shown in FIGS. 7 through 9 may be used to overcome the problem. To prevent adhesion of the loops 12 into the thermoplastic material 24, the roll 20 may be a pattern or embossed roll with a pattern cut into the roll surface with high areas and low areas so that only a portion of the loops 12 are embedded in the thermoplastic material 24 when the backcoated fabric 28 is cooled. It is contemplated that sufficient loops 12 will remain free and upright if the pressure area on the roll 20 in contact with the chill roll 22 is in the range of about 19% to about 80%, and more preferably in the range of about 30% to about 60%.

In FIG. 7, it should be noted that the embossing roll 20 contacts the loop side of the fabric, but this is merely for efficient location of the machine elements and, if desired, the fabric 10 can be embossed on the side of the fabric away from the loops 12 to obtain the same desired results. This embossment of the non-loop side of the fabric 10 may be performed in the modification shown in FIG. 8.

FIG. 9 illustrates one embodiment of the current invention, wherein the backcoated fabric 28 may be exposed to a printing process which imparts printed images 48 to the face of the backcoated fabric 28. Thus, a face printed loop fabric 50 may be achieved.

Printing may be accomplished by a variety of known printing techniques such as transfer printing, screen printing, digital printing, ink jet printing, flexographic printing, or any other technique that is common in the art for comparable, equivalent, traditional textile products. Flexographic printing, which may be a preferred printing method, is well known by those skilled in the art and is described, for example, in U.S. Pat. No. 5,003,873 to Lauber; U.S. Pat. No. 6,101,940 to Huff; U.S. Pat. No. 5,979,315 to Hann et al.; U.S. Pat. No. 6,408,754 to Siler et al.; and U.S. Pat. No. 5,048,418 to Hars et al., all of which are herein incorporated by reference.

FIG. 10 is a schematic drawing which illustrates the basic flexographic printing process 100. Generally, ink 110 from an ink chamber (not shown) is transferred to the backcoated fabric 28 by way of a rotating cylindrical ink roller 120, or anilox cylinder, and a printing plate 130 which is mounted on a rotating printing cylinder 140. The image to be printed on the fabric 28 is etched or engraved in the anilox cylinder 120. The recesses 150 created by the etching or engraving form ink-retaining grooves or cells in the anilox cylinder 120, which allow for the subsequent transfer of ink 110 from the anilox cylinder 120 to the printing cylinder 140. Before the transfer process, the anilox cylinder 120 comes into contact with one or more blades 170 (i.e., doctor blades) which act as squeegees to remove excess ink from the anilox cylinder 120. The surface of the printing plate 130 is typically shaped so that the image to be printed appears in relief, in the same way that rubber stamps are cut so as to have the printed image appear in relief on the surface of the rubber.

The anilox cylinder 120 generally rotates at high speed such that the raised surface of the printing plate 130 contacts the anilox cylinder 120, is slightly wetted by the ink 110, and then contacts the fabric 28, thereby transferring ink 110 from the raised surface of the printing plate 130 to the fabric 28 to form a printed image on the surface of the fabric 28. Backing cylinder 180 provides adjustable pressure to the fabric 28 as it passes through the nip of the backing cylinder 180 and anilox cylinder 120. Each color used to form a printed image generally requires its own anilox cylinder, printing plate, and printing cylinder, and the colors are typically printed one after the other onto the fabric 28 as it passes through the flexographic printing machine to form printed loop fabric 50 and 60.

Figure 11:
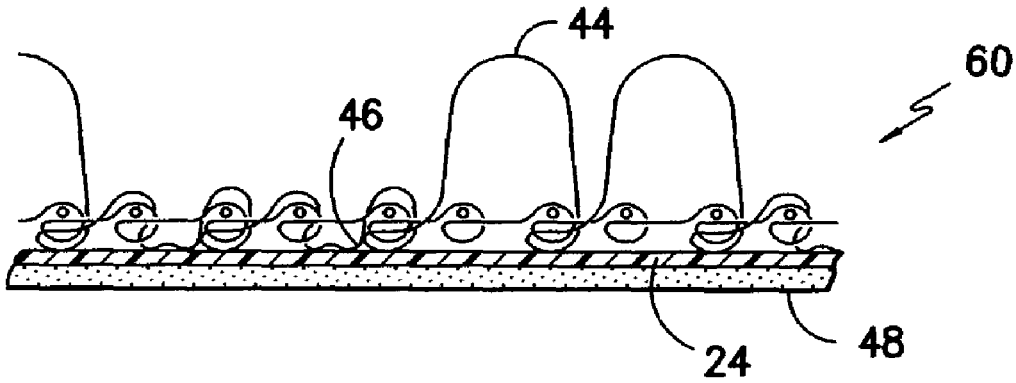
FIG. 11 is a view similar to FIG. 6 showing another embodiment of the printed loop fabric of the present invention with printing on the thermoplastic material on the backside of the loop fabric.

FIG. 11 illustrates yet another embodiment of the current invention, wherein the backcoated fabric 28 shown in FIG. 6 may be exposed to a printing process which imparts printed images 48 to the thermoplastic material 24 of backcoated fabric 28. Thus, a printed loop fabric 60 is achieved. Printing may be accomplished by any of the methods disclosed above, although flexographic printing may be preferred.

Figure 8:
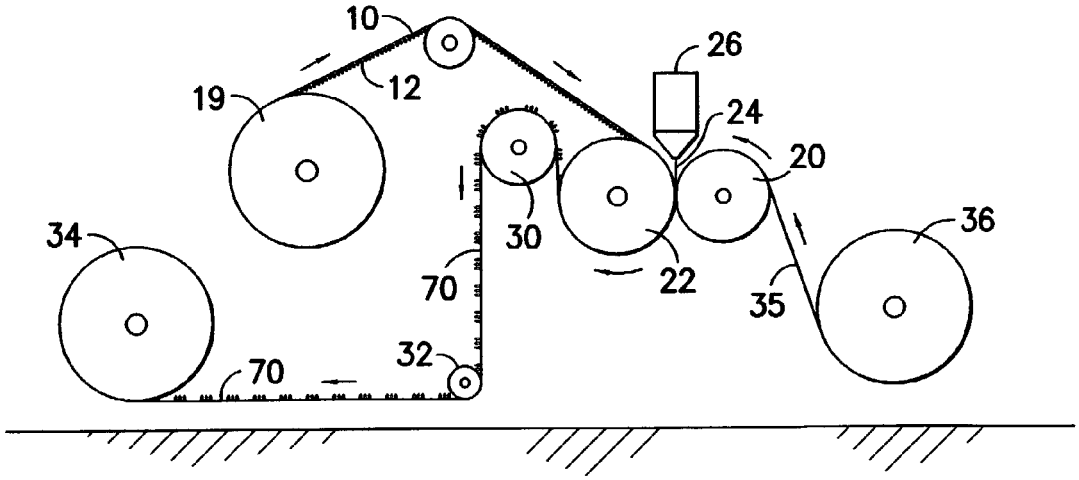
FIG. 8 is a modified form of the backcoating process shown in FIG. 7.
Figure 12:
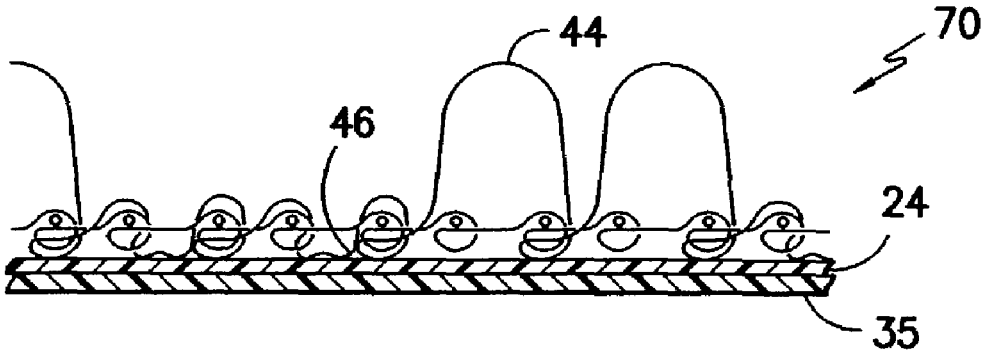
FIG. 12 is a view similar to FIG. 6 further showing one embodiment of the printed low loop fabric of the present invention having a pre-printed thermoplastic film laminated to the thermoplastic material on the backside of the fabric.

FIGS. 8 and 12 illustrate another embodiment of the current invention, wherein a pre-printed film 35 may be laminated to the thermoplastic material 24 of the backcoated fabric 28. As shown in FIG. 8, the pre-printed film 35 from the supply roll 36 is passed over roll 20 in contact with the non-loop side of the fabric 10 at the nip of the chill roll 22 and roll 20 while the thermoplastic material 24 is extruded therebetween to laminate the film 35 to the fabric 10. As in FIG. 7, the laminated fabric 70 is supplied to take-up roll 34 over guide rolls 30 and 32. Thus, a printed low loop fabric 70 is achieved which relies upon the see through properties of the fabric to view the printed image.

The pre-printed film 35 may be comprised of any thermoplastic material. Suitable thermoplastic materials include polyolefin, polyester, polyamide, polyurethane, acrylic, silicone, melamine compounds, polyvinyl acetate, polyvinyl alcohol, nitrile rubber, ionomers, polyvinyl chloride, polyvinylidene chloride, chloroisoprene, or combinations thereof. The polyolefin may be polyethylene, polypropylene, ethylvinyl acetate, ethylmethyl acetate, or combinations thereof. It may be preferable that the pre-printed film is comprised of polyethylene, polypropylene, or blends thereof. It may be even more preferable that the pre-printed film is polyethylene comprised of a blend of low density and linear low density polyethylene.

Additionally, after the steps of fabric formation, coating the fabric with a thermoplastic material, and/or lamination of the fabric with a pre-printed film, the fabric may be treated with one or more mechanical finishes. For example, it may be desirable to expose the fabric to one or more mechanical finishes such as exposure to a high friction roll, napping, brushing, sanding, exposure to water, air, or other fluid, and the like, or combinations thereof. Any one of these mechanical treatments may be used to lift any loops that may be lightly bonded in the thermoplastic material in preparation for engagement with the hooks of the mechanical closure system. Exposure to a high friction roll or a brushing roll are preferable mechanical finishing processes used for lifting the loops of the fabric, while avoiding breakage of any of the loops. It may be preferable that this step of lifting the loops of the fabric occurs as the final step in the process of creating a printed loop fabric.

EXAMPLES

Examples 1 through 4 are provided to illustrate the improvement of printed low loop fabric over printed standard loop fabric (or loop fabric having longer loops). More specifically, these Examples illustrate that the increased open space achieved by the low loop fabric provides improved clarity and visibility of the printed image which may be placed either directly on the face of the low loop fabric, on the thermoplastic material on the backside of the low loop fabric, or on a pre-printed film which may be laminated to the thermoplastic material on the backside of the low loop fabric. These embodiments are accomplished without sacrificing the hook to loop engagement strength of the mechanical closure system.

Example 1

FIG. 13A shows a scanned image of standard loop fabric having a knit construction shown by the knit pattern in FIG. 4. The 100% polyester fabric had a warp knit, weft inserted construction comprised of 9 wales by 18 courses with a 3-needle loop size. The fabric was comprised of 1/100/34 denier textured polyester warp (or loop) and weft yarn and a 1/40/24 denier untextured (or flat) polyester chain stitch yarn (may also be referred to as a "tie" yarn which connects the warp yarns with the weft yarns). The fabric had a weight of 30 g/m$^2$.

FIG. 13B shows a scanned image of low loop fabric having a knit construction as shown by the knit pattern in FIG. 5. The 100% polyester fabric had a warp knit, weft inserted construction comprised of 9 wales by 18 courses with 1 needle loop size. The fabric was comprised of 1/70/34 denier textured polyester warp (or loop) and weft yarn and a 1/40/24 denier untextured (or flat) polyester tie yarn. The fabric had a weight of 20 g/m$^2$. It is readily observed in comparing the low loop fabric with the standard loop fabric that the low loop fabric provides more open space between the warp and weft yarns which provides improved visibility and clarity of a printed image which may be applied to the back of the low loop fabric.

Example 2

FIG. 14A shows a scanned image of the low loop fabric as described and shown in FIG. 13B. The low loop fabric had a thermoplastic material extrusion coated to the backside of the fabric. In this instance, the thermoplastic material was comprised of a blend of 80% by weight of polypropylene and 20% by weight of low density polyethylene. This product was commercially available from Huntsman Corporation of Houston, Tex. under the product name P9H7M-026. A printed image was then applied to the thermoplastic material on the backside of the fabric using flexographic printing. The flexographic inks used were water-based inks available from Environmental Inks of Morganton, N.C. under the product name Flex II. These inks contained an acrylic based binding agent to assist in the adherence of the ink to the substrate on which the ink was placed.

For comparison purposes, FIG. 14B shows a scanned image of the low loop fabric as described and shown in FIG. 14A, except the printed image was applied to the face of the fabric, rather than to the thermoplastic material on the backside of the fabric. The printed image was applied to the face side of the fabric using flexographic printing. In this application process, it may be desirable to apply a clear coating over the printed image to protect the image from abrasion and ultraviolet light. The clear coating may be an acrylic based emulsion. The resulting face printed fabric shown in FIG. 14B clearly illustrates the improved clarity and visibility of the printed image obtained by printing on the face of the fabric, rather than printing on the backside of the fabric and relying on the see through characteristics of the fabric in order to view the printed image.

Example 3

A thermoplastic material was extrusion coated to the backside of the standard loop fabric described in Example 1 and shown in FIG. 13A. The thermoplastic material was P9H7M-026 as disclosed in Example 2 above. A pre-printed 1.25 mil polyethylene film was also extrusion coated to the thermoplastic material on the backside of the standard loop fabric. The film was available from ISO Polyfilms located in Gray Court, S.C.

The same thermoplastic material and pre-printed 1.25 mil polyethylene film as described above was extrusion coated to the backside of the low loop fabric described in Example 1 and shown in FIG. 13B. The comparison of the standard loop fabric with the low loop fabric clearly illustrates the improved visibility and clarity of the printed images contained within the pre-printed film laminated to the backside of the low loop fabric.

Example 4

The same low loop fabric described above in Example 2, but without any printing, was tested for hook to loop engagement strength after exposure to a high friction roll. The fabric was tested for Peel Strength according to ASTM-D5170-98 and for Shear Strength according to ASTM-D5169-98. These two tests are indicative of the hook to loop engagement strength of fabric used in mechanical closure systems.

The hook material was purchased from YKK Corporation of Macon, Ga. under the product name, "WE". Sample 1 was the control sample, which was not exposed to the high friction roll. Samples 2 through 4 were exposed to the high friction roll, and the direction of the high friction roll was opposite to the direction of the fabric flow through the machine. The results are shown in Table 1 below.

TABLE 1

Comparison of Hook to Loop Engagement Strength of Low Loop Fabric Before and After Exposure to High Friction Roll

| Sample | Fabric Tension | Peel Strength (Grams/inch) | Shear Strength (Grams/inch) |
|---|---|---|---|
| 1 (control) | n/a | 196 | 1491 |
| 2 | Low | 305 | 5127 |
| 3 | High | 363 | 5721 |
| 4 | Low | 355 | 3949 |

It is readily known to those skilled in the art of loop fabrics, and more specifically diaper loop fabrics, that acceptable peel strength results are in the range of about 200 to about 400 grams per inch of fabric and that acceptable shear strength results are in the range of about 3000 to about 4000 grams per inch of fabric. The results in Table 1 indicate that exceptional peel and shear strength are achieved for the low loop fabric after exposure to a high friction roll for the purpose of lifting loops which have been lightly bonded to the thermoplastic material. The results in Table 1 provide further illustration that the low loop fabric provides improved graphic visibility and clarity while maintaining sufficient hook to loop engagement strength as desired for the fabric's end use as the female portion of a mechanical closure system.

It can readily be seen that a printed loop fabric has been disclosed which can readily function as the female member of a hook and loop connection and which exhibits improved clarity and visibility of a printed image when compared with other similarly constructed fabrics. The process of flexographic printing the face of the fabric composite, as described in one embodiment of the invention, eliminates the need to rely upon the "see through" characteristics of the fabric, adhesive, or film comprising the product, in order to see the printed image, thereby providing improved clarity and visibility of the printed image. Because of the increased openness between the yarns comprising the low loop fabric, the process of printing on the thermoplastic material on the backside of the fabric results in a printed loop fabric having improved graphic clarity and visibility. Similarly, laminating a pre-printed film to the thermoplastic material on the backside of a low loop fabric results in improved clarity and visibility of the pre-printed image contained within the film.

Furthermore, the printed loop fabric does not readily tear due to the weft inserted yarn that provides stability in the weft direction of the fabric, and backcoating the fabric with a thermoplastic material provides stability to the fabric and does not tie down all of the loops of the fabric thereby preventing the destruction of the retention power or the ease of releasement of the hook and loop connector. Additionally, the printed loop fabric is relatively inexpensive, simple, and straight forward to manufacture.

These and other modifications and variations to the present invention may be practiced by those of ordinary skill in the art, without departing from the spirit and scope of the present invention. Furthermore, those of ordinary skill in the art will appreciate that the foregoing description is by way of example only, and is not intended to limit the scope of the invention described in the appended claims.

We claim:

1. A method of providing a printed warp knit, weft inserted fabric comprising the steps of:

(a) supplying a warp knit, weft inserted fabric having a face side and a backside, said backside of said fabric having a plurality of spaced wales of stitches with a lap portion of each of said stitches projecting outwardly therefrom to form a free loop connected only at its base to its respective wale with adjacent loops in each wale tilted sidewise alternately in opposite directions and a weft yarn inserted into the courses of the fabric between the face and backside of the fabric and extending across the full width of the fabric;

(b) transporting the warp knit, weft inserted fabric into the nip of a chill roll and a pressure roll;

(c) supplying a molten thermoplastic material into the nip of the chill roll and the pressure roll onto the backside of said warp knit, weft inserted fabric; and (d) printing the face side of said warp knit, weft inserted fabric.

2. The method of claim 1, wherein the step of supplying said molten thermoplastic material to the backside of said warp knit, weft inserted fabric is accomplished by the process of extrusion coating.

3. The method of claim 1, wherein the step of printing is achieved by flexographic printing.

4. The method of claim 1, wherein the step of printing is followed by the application of a clear coating to the face side of said warp knit, weft inserted fabric.

5. The method of claim 1, wherein the pressure roll is an embossing or patterned roll with a pattern cut into the roll surface with high areas and low areas.

6. The method of claim 5, wherein the percentage of loops held down by the thermoplastic material is in the range of about 19% to about 80%.

7. The method of claim 6, wherein the percentage of loops held down by the thermoplastic material is in the range of about 30% to about 60%.

8. The method of claim 1, wherein the step of printing is followed by the step of exposing said warp knit, weft inserted fabric to a mechanical finishing process to lift the loops of said warp knit, weft inserted fabric.

9. A method of providing a printed loop pile fabric comprising the steps of:

(a) supplying a loop pile fabric having a face side and a backside, wherein said face side is characterized by loops projecting outwardly therefrom;

(b) transporting the loop pile fabric into the nip of a chill roll and a pressure roll;

(c) supplying a molten thermoplastic material into the nip of the chill roll and the pressure roll onto the backside of said loop pile fabric; and (d) printing the face side of said loop pile fabric.

10. The method of claim 9, wherein the step of supplying said molten thermoplastic material to the backside of said loop pile fabric is accomplished by the process of extrusion coating.

11. The method of claim 9, wherein the step of printing is achieved by flexographic printing.

12. The method of claim 9, wherein the step of printing is followed by the application of a clear coating to the face side of said warp knit, weft inserted fabric.

13. The method of claim 9, wherein the pressure roll is an embossing or patterned roll with a pattern cut into the roll surface with high areas and low areas.

14. The method of claim 13, wherein the percentage of loops held down by the thermoplastic material is in the range of about 19% to about 80%.

15. The method of claim 14, wherein the percentage of loops held down by the thermoplastic material is in the range of about 30% to about 60%.

16. The method of claim 9, wherein the step of printing is followed by the step of exposing said loop pile fabric to a mechanical finishing process to lift the loops of said loop pile fabric.

* * * * *